United States Patent [19]

Holbert

[11] 4,449,595

[45] May 22, 1984

[54] METHOD AND APPARATUS FOR DRILLING A CURVED BORE

[76] Inventor: Don R. Holbert, 6637 W. Hinsdale Ave., Littleton, Colo. 80123

[21] Appl. No.: 378,786

[22] Filed: May 17, 1982

[51] Int. Cl.[3] ..... E21B 10/30

[52] U.S. Cl. ..... 175/79; 175/325; 175/344; 175/406

[58] Field of Search ..... 175/61, 75, 79, 80, 175/81, 325, 344, 345, 385, 401, 406, 408; 166/117.5

[56] References Cited

U.S. PATENT DOCUMENTS

| | | | |
|---|---|---|---|
| 1,595,922 | 8/1926 | Prindle . | |
| 1,844,371 | 2/1932 | Santiago | 175/345 |
| 2,131,849 | 10/1938 | Tolson | 255/1 |
| 2,544,982 | 3/1951 | Buttolph | 255/1.6 |
| 2,589,534 | 3/1952 | Buttolph | 255/28 |
| 2,646,253 | 7/1953 | Johnston | 175/325 |
| 2,669,428 | 2/1954 | Zublin | 255/1.6 |
| 2,687,282 | 8/1954 | Sanders | 255/1.6 |
| 2,797,893 | 7/1957 | McCune et al. | 175/79 |
| 2,829,864 | 8/1958 | Knapp | 255/1.6 |
| 2,953,350 | 9/1960 | Moore | 255/1.6 |
| 3,052,310 | 9/1962 | Kinzbach | 175/406 |
| 3,116,799 | 1/1964 | Lemons | 175/61 |
| 3,322,217 | 5/1967 | De Orr Cook | 175/406 |
| 3,349,845 | 10/1967 | Holbert | 166/4 |
| 3,833,077 | 9/1974 | Lavallee | 175/325 |
| 3,945,447 | 3/1976 | Peterson | 175/345 |
| 4,067,404 | 1/1978 | Crase | 175/75 |
| 4,304,311 | 12/1981 | Shinn | 175/325 |

FOREIGN PATENT DOCUMENTS

| | | | |
|---|---|---|---|
| 47804 | 1/1978 | U.S.S.R. | 175/325 |

*Primary Examiner*—Stephen J. Novosad
*Assistant Examiner*—William R. Neuder
*Attorney, Agent, or Firm*—John E. Reilly

[57] ABSTRACT

A reamer apparatus is adapted for use in combination with a radial whipstock assembly in drilling a curved bore in a subsurface formation at a predetermined angle of build. The reamer apparatus is comprised of a drill bit, at least one articulated joint or drill collar connected to the lower end of the drill string, and a stabilized reamer interconnected for rotation behind the drill bit which includes cutter blades overgauged in relation to the drill bit and projecting substantially in outward radial directions from the reamer body, each blade having an elongated cutting edge which extends substantially parallel to the direction of drilling and a stabilized leading end so as to stabilize the reamer and avoid preferential cutting as the drill bit proceeds along the desired course.

12 Claims, 7 Drawing Figures

METHOD AND APPARATUS FOR DRILLING A CURVED BORE

This invention relates to earth-boring; and more particularly relates to a novel and improved method and apparatus for drilling curved bores, such as, drainholes at a predetermined angle of build away from an original bore, for example, in the recovery of oil and gas from subsurface formations.

BACKGROUND AND FIELD OF INVENTION

In my U.S. Pat. No. 3,398,804, entitled "Method of Drilling a Curved Bore", there is disclosed a method of drilling a curved bore and wherein the desired direction or course is maintained by the relationship established between the bit, reamer and knuckle joint when used in combination with a deflecting tool, such as, a radial whipstock assembly. As discussed in my hereinbefore-referred to patent, the radius of curvature of the curved bore or drainhole necessary to proceed from the original bore to the desired termination point or nadir will determine the radius of curvature to be given the guide surface of the deflecting tool. This, of course, presupposes that the reamer and bit will proceed along the same radius of curvature established by the guide surface. From this radius of curvature, it is possible to determine the angle building capacity of the directional drilling apparatus from the equation $$RC = \frac{L^2}{2a}$$

where RC is the radius of curvature, L is measured from the center line of the knuckle joint to the center line of the reamer and a is the distance between the center line of the reamed hole to the center line of the knuckle joint. This relationship still holds true in the drilling of drainholes and assures greater predictability and accuracy in drilling along a predetermined course from a zenith or starting point to the nadir or desired termination point.

In actual practice, it has been found that the angle building capacity of the reamer apparatus may be substantially altered as a result of preferential or increased cutting of the reamer into one portion or wall of the bore. In other words, if the reamer were to cut more deeply into the top of the hole than the bottom it would tend to straighten out the knuckle joint and connected drill string, and the angle building capacity of the tool would be substantially reduced. In the past, little or no attention has been paid to the effect of the reamer design and construction and the important role which the reamer plays in causing the bit to follow a predetermined angle of build. It was assumed that, once the predetermined radius of curvature was established by the guide surface of the deflecting tool, the bit would continuously make a full cut off the bottom of the hole and guide the reamer to uniformly cut the sides of the hole as it follows the bit. In the past, various types of reamers have been employed, such as, blade or spiral-type reamers on the premise that the reamer merely followed the cutting action of the bit along a predetermined radius of curvature in drilling the curved bore. However, it has been found that the reamer will not always follow the radius of curvature established by the guide surface of the deflecting tool but in fact may be influenced by a number of conditions which may alter the actual course of advancement of the reamer as well as the bit. Generally, reamer cuttability will depend to a great extent on rock properties, cutter design, cutter materials, forces or applied loads on the cutter, depth of cut, rotary speed and other factors. Most notably, however, conventional reamers exhibit a tendency to preferentially cut in an upward direction and, as a result, cause a reduction in angle build and an increase in the radius of curvature of the curved bore.

It has been recognized previously that the size of the reamer may vary from that required to cut or ream the bore and prevent stabilization of the bit to a size at which the axial applied load on the apparatus is so great that the reamer is unable to satisfactorily cut. If the reamer does not cut, it operates more as a stabilizer so as to lift the upper joint or drill collar toward the center line of the hole thereby reducing the distance a and increasing the dimension L in the foregoing equation. For this reason, the approach taken in the past has been to make the reamer slightly overgauged and assure that it is capable of cutting substantially along its entire length and particularly at the leading edge or edges of the reamer blades. However, it has now been discovered that a uniform stabilizing action which is concentrated at the leading end is required if the drilling apparatus is to follow a predictable angle of build or radius of curvature and nevertheless retain the ability to uniformly cut or ream the wall or sides of the hole in following the cutting action of the bit. Representative patents on conventional reamer designs are U.S. Pat. Nos. 1,595,922 to O. C. Prindle; 2,131,849 to E. O. Tolson; 2,544,982 to R. Buttolph; 2,589,534 to R. Q. Buttolph; 2,669,428 to J. A. Zublin; 2,687,282 to E. L. Sanders; 2,829,864 to S. R. Knapp; 2,953,350 to S. C. Moore; 3,116,799 to R. Lemons; 3,349,845 to D. R. Holbert et al; and 4,067,404 to G. M. Crase.

SUMMARY OF THE INVENTION

It is therefore a feature of the present invention to provide for a novel and improved method and apparatus for drilling curved bores wherein the apparatus is capable of following a predetermined angle of build and of avoiding preferential cutting or deflection.

Another object of the present invention is to provide for a novel and improved reamer apparatus for use in drilling curved bores which is capable of rapidly driving a bit to a stabilized position and of guiding the bit along a predetermined radius of curvature or angle of build while effectively reaming the bore behind the cutting action of the bit.

It is a further object of the present invention to provide for a novel and improved stabilized reamer in which bit "pinching" and fatique stresses are minimized in drilling curved bores.

Yet another object of the present invention is to provide for a novel and improved drilling assembly for drainholes which minimizes the ability of anisotropic rock to modify the position of the drilling assembly and specifically to avoid preferential cutting or deflection of the bit in proceeding along a predetermined angle of build.

In accordance with the present invention, a reamer apparatus has been devised for attachment to a rotary drill string and which is specifically adapted for use in combination with a radial whipstock assembly in drilling a curved bore in a subsurface formation. The preferred apparatus comprises a drill bit, at least one articulated joint or drill collar connected to the lower end of the drill string, and a reamer which is interconnected for rotation between the articulated joint or drill collar and the drill bit, the reamer including a plurality of cutter blades overgauged with respect to the drill bit and projecting substantially in outward radial directions from the body of the reamer. Each blade has an elongated cutting edge extending substantially parallel to the direction of drilling, and a stabilizer disposed between the reamer and the drill bit whereby to stabilize the reamer and avoid preferential cutting by the cutter blades as the reamer follows the advancement of the drill bit. In the preferred form, the reamer is mounted in association with a stabilizer member which is rigidly connected to the drill bit, the stabilizer being provided with flow channels therein together with notched portions through which the cutter blades extend. At least the cutting edges of the cutter blades are formed with a hard surfacing material which can be resurfaced or replaced so as to avoid replacement of the entire reamer when the cutting edges become worn.

In drainhole drilling operations, the apparatus of the present invention is initially folded into the desired angle building position by a whipstock or other suitable assembly which will establish the desired initial curvature to initiate drilling along the predetermined radius of curvature. As previously enunciated in my earlier U.S. Pat. No. 3,398,804, the angle build or radius of curvature is established by the tangent line of the bit-reamer axis in accordance with the equation $$RC = \frac{L^2}{2a}.$$

The cutter blades or teeth of the reamer are so mounted and arranged that the reamer will accurately follow the preselected angle build or radius of curvature. In other words, the limited radial projection of the leading end surfaces of the cutter blades will avoid preferential or side cutting particularly along the top or upper side of the hole. Stabilization is enhanced by the use of a separate stabilizer element in leading relation to the reamer so that effectively only the longitudinal cutting edges of the reamer project beyond the surface of the stabilizer and are stabilized in following the cutting action of the bit.

The above and other objects, advantages and features of the present invention will become more readily understood and appreciated from a consideration of the following detailed description of a preferred embodiment when taken together with the accompanying drawings in which:

DETAILED DESCRIPTION OF THE PREFERRED EMBODIMENT

Figure 1:
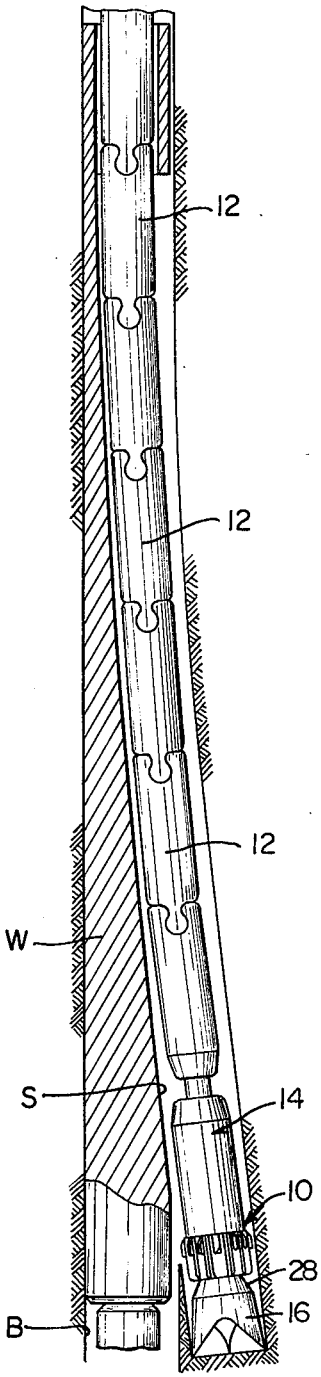
FIG. 1 is a cross-sectional view illustrating the mounting and disposition of a preferred form of reamer assembly in relation to a radial whipstock in accordance with the present invention.

The present invention is best typified by describing its use in drainhole drilling which by definition is a variant of directional drilling operating in more extreme curvatures to the extent that the drainhole will proceed through a curved section from a vertical or substantially vertical well bore into a substantially horizontal section; and, in many case, followed by a straight or stabilized section. The curved section may be quite sharp with radii as small as 12′ and seldom larger than 40′ while the stabilized section is not truly straight but normally a curved section of much greater radius on the order of 300′ to 500′. FIG. 1 illustrates the manner of folding a preferred form of reamer apparatus 10 along the curved guide surface S of a standard radial whipstock W which is positioned in a vertical bore represented at B. The preferred form of reamer apparatus 10 in accordance with the present invention is fixed to the lower end of a rotary drill string having a series of articulated joints 12 terminating at their lower end in a universal or knuckle joint 14. A standard drill bit 16 is secured to the knuckle joint 14 by a reamer assembly 18 which includes a stabilizer section 20 and a reamer body 22 mounted at the upper end of the stabilizer and which reamer body is provided with a series of circumferentially spaced, radially projecting cutter blades 24.

Considering in more detail the construction and arrangement of the reamer apparatus, in applications where the angle build is not as extreme as that required in drainhole drilling, it is possible to dispense with the use of articulated joints and employ a drill collar. The drill bit 16 may be selected from any number of conventional constructions employed in directional drilling or drainhole operations with a tapered, threaded stem portion 28 projecting into a socket end portion 30 of the reamer 18. The entire reamer assembly 18 is of hollow, generally cylindrical configuration in which the stabilizer section 20 includes a series of longitudinally extending flow channels 32 formed as circumferentially spaced grooves in its external surface, and circumferentially spaced open slots or notches 34 are formed at the trailing end of the external surface of the stabilizer section 20 opposite to the drill bit 16. A tapered, threaded stem or sub 36 projects rearwardly from the stabilizer section to effect threaded connection with a socket end portion 38 at the lower end of the knuckle joint 14.

The reamer 22 is assembled onto the stabilizer section 20 as a preliminary to its connection to the knuckle joint 14 and is defined by an annular body with the radially outwardly projecting teeth or cutter blades 24 arranged in spaced circumferential relation to one another. If desired, minor shifts in angularity can be made to reduce chattering and make a smoother cut. Each of the cutter blades 24 is elongated in a direction parallel to the longitudinal axis of the assembly 18 and has spaced, parallel sidewalls 44 projecting radially from the annular body 22 terminating in a generally rectangular end portion so as to form a squared end 45 on its external surface. Each cutter blade has a leading end 46 which inclines both in a radial outward direction away from the body into the leading end of the cutting edge 45 as well as being inclined laterally at an acute angle to the longitudinal axis or length of each cutter blade. In turn, a trailing end surface 48 inclines or slopes away from the annular body 22 in a direction toward the bit 16 and terminates at one end of the external cutting edge portion 45. It will be noted that the leading edges or corners 50 formed at the intersection of each leading end surface 46 and sidewall 44 are rounded so as to form cutting edges of limited depth. However, edges or corners 52 formed at the intersections of the external end portion 45 and the sidewalls 44 are extremely sharp or pointed along their entire length to bring these cutting edges within a close tolerance of the desired diameter; and the same is true of the edges 54 formed at the intersection of the trailing end surface 48 and the parallel sides 44.

Preferably, the exterior of each cutter blade 24 is covered with a hard surfacing or coating material, such as, tungsten carbide in a form suitable for cutting rock, along the leading or cutting end surface and the exterior cutting edge surface; and the body of each tooth is formed or composed of a relatively mild steel material. Thus, the external, hard surfacing material will be more resistant to wear and can be readily replaced or resurfaced after becoming worn in preference to replacement of the entire reamer body. The trailing tapered end surface is usually surfaced with a hard surfacing or coating material, such as, a tungsten carbide designed to cut metal in the event minor amounts of metal or casing must be reamed away to facilitate withdrawal of the drilling assembly from the drainhole into the well casing via the whipstock. The inclined, leading end surface 46 and particularly its initial inclination in a transverse or lateral direction 21 with respect to the axis of the tool minimizes any tendency of the reamer to jam but at the same time enables it to rapidly drive into a stabilized position without preferential cutting. Thus, any cutting is restricted to limited radial projection of the leading end 46 beyond the drill bit and the longitudinally directed edges 52 of the external cutting edge surface as the assembly is driven forwardly into the subsurface formation. In this relation, the stabilizer section 20 is dimensioned such that each cutter blade projects but a limited extent beyond the diameter of the enlarged leading end of the stabilizer section. For instance, for a stabilizer on the order of 4.8125" in diameter, the cutter blades are dimensioned to radially project 0.026" beyond the notched end of the stabilizer. It will be noted that the notches or slots 34 for the blades are open; i.e., extend through the end of the stabilizer body so that the reamer body 22 may be inserted into an annular cavity 56 of the stabilizer between its notched end and the inner threaded sub section 36.

In practice, the whipstock assembly W is initially anchored in place at the bottom of the original or vertical bore B. The whipstock is given a guide surface S having a radius of curvature corresponding to that of the drainhole to be drilled and will be oriented, in accordance with conventional practice, to initiate directional drilling along the curved bore in the desired compass direction. The flexible shaft or series of articulated joints 12 are assembled onto the drill string and are of any suitable construction which will permit the drill string to follow the bit 16 along a curved bore to be drilled laterally away from the original bore while transmitting torque to the drill bit 16. The universal or knuckle joint 14 is assembled onto the lower end of the articulated joints 12 so as to define a universal connection between the joints and reamer and will transmit drilling torque from the joints 12 into the drilling bit 16. Again, the radius of curvature or angle of build of the curved bore is established by the relationship of $L^2/2a$. Generally, in selecting the dimensions for the drill bit and reamer apparatus, the knuckle joint 14 must be of a lesser diameter than that of the drill bit 16 and of a diameter approximating that of the articulated joint 12. The distance L is measured between the pivotal axis of the knuckle joint 14 and the leading edge of the reamer blades 50, and the dimension a is measured between the center line of the joint 14 and the desired radius of the curved bore. The latter dimension is relatively set; however, the dimension L may be varied over a wide range in order to establish the desired angle building capacity. The amount of preferential cut acts to modify both these dimensions in a fairly significant manner. The simple equation is strictly true only for all cutting at the bottom. Better angle build accuracy is obtained when the cut is balanced, so the effects of cutting at the top must then be incorporated into the radius of curvature calculations. In drainhole operations, this angle building capacity or angle build may typically range from 2° per foot to as much as 5° per foot.

Figure 2:
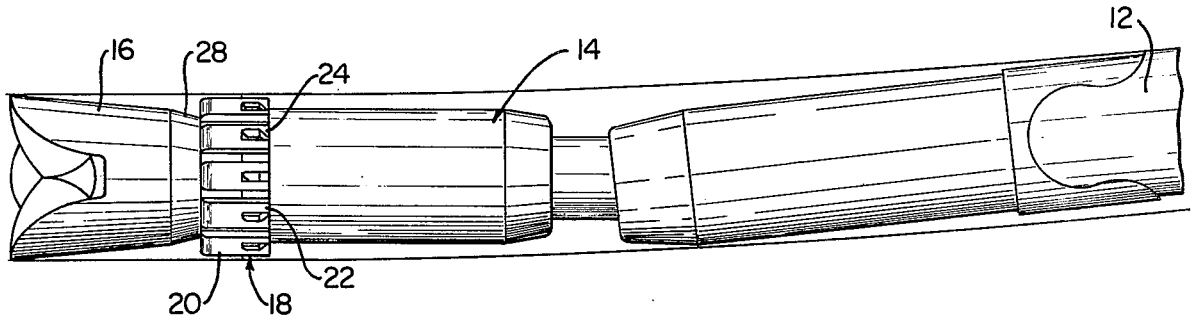
FIG. 2 is an enlarged view in more detail of the preferred form of reamer apparatus in its extension along a curved essentially horizontal bore section.
Figure 3:
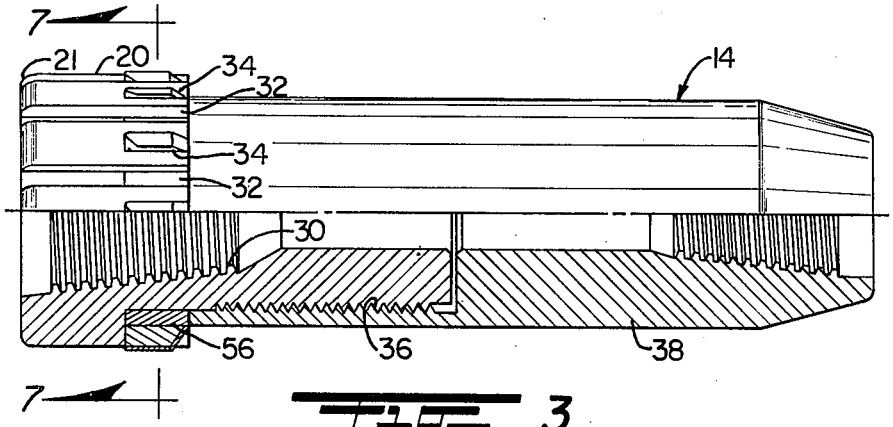
FIG. 3 is a view partially in section of the preferred form of reamer apparatus in accordance with the present invention.
Figure 4:
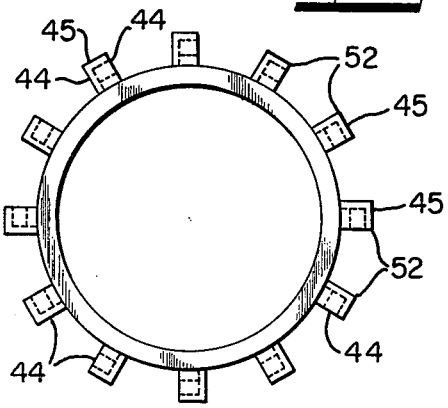
FIG. 4 is an end view of the preferred form of reamer member.
Figure 5:
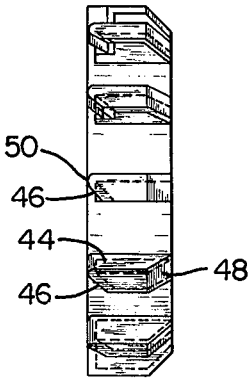
FIG. 5 is a side view of the reamer member shown in FIG. 4.
Figure 6:
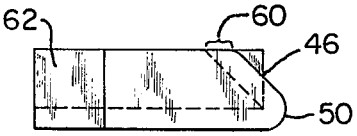
FIG. 6 is an enlarged view in more detail of one of the cutter blades of the reamer member shown in FIGS. 4 and 5.
Figure 7:
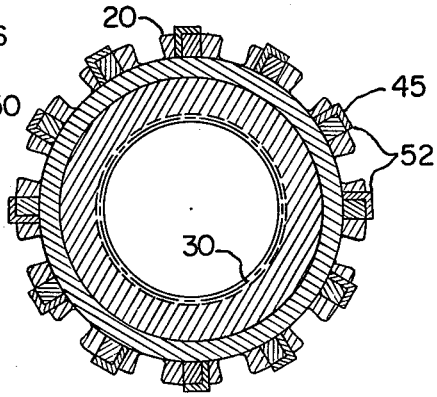
FIG. 7 is a cross-sectional view taken about lines 7—7 of FIG. 3.

In order to commence directional drilling operations, the assembled reamer apparatus is run into the radial whipstock assembly following its insertion into the original bore and anchoring of the whipstock W. Application of a downward pressure and rotation of the drill string will be imparted to the drill bit 16 to cause it to advance along the predetermined radius of curvature as established by the guide surface S and dimensional relationship between the reamer, knuckle joint and reamer diameter. Under the downward pressure applied to the drill string, the knuckle joint 14, being of a lesser diameter than the drill bit 16, will tend to fold against the guide surface of the radial whipstock so that the axis of the reamer 18 will assume a slight angle to the guide surface as illustrated in FIG. 1. Accordingly, the bit will tend to preferentially cut toward the upper side of the curved bore and to proceed laterally along the radius of curvature selected. Under continued drilling, depending upon the angle of build desired, the bit will ultimately assume an essentially horizontal direction of advancement as illustrated in FIG. 2 with respect to the original bore B. Periodically, the compass direction or bearing of the curved bore may be measured by conventional procedures to ascertain that the reamer apparatus and bit are proceeding along the correct course. Once the curved bore has been drilled to the desired depth or termination point, the drill string can be withdrawn by pulling back along the guide surface of the whipstock to remove the entire assembly from the curved bore. The trailing edges or end surface 48 of the cutter blades will minimize any tendency of the assembly to become jammed or stuck in the bore in retracting along the radial whipstock assembly. If additional drainholes are to be drilled, the radial whipstock may be reoriented to the desired direction and the directional drilling or drainhole operation repeated as described. In this relation, various coating or hard surfacing techniques may be applied. For instance, as described the entire cutter blade may be surfaced with a Dynalloy tube metal to the desired thickness as designated at 60 in FIG. 6. Moreover, if desired, a somewhat different type of surfacing material may be applied to the trailing end surfaces of the cutter blades, such as, a Kutrite material in a metallic base as applied along the surface area 62. The entire surface of the cutter blade covered by the Dynalloy and Kutrite is then radius ground after surfacing as described.

The reamer apparatus of the present invention is stabilized in the sense that the stabilizer section at the leading end of the reamer will discourage any tendency of the reamer to preferentially cut especially in a direction toward the upper side of the hole. On the other hand, the reamer will overcome any tendency to completely stabilize the bit by virtue of its longitudinal cutting edges. By minimizing any tendency of the reamer blades to preferentially cut, particularly in a direction toward the convex or upper side of the bore, the angle of build can be accurately predicted. The forces acting to move or deflect the knuckle joint 14 can be reduced by increasing the ratio of the length between the end of the drill bit 60 or knuckle joint 14 and that between the leading ends of the reamer blades 24 and knuckle joint 14. Although variable conditions, such as, rock properties, cutter design and materials, forces on the cutters, depth of cuts, rotary speeds, etc. will affect reamer cuttability, nevertheless, by designing the reamer apparatus to be overgauged, tapered and non-cutting at its leading end will influence the reamer to rapidly advance to a stabilized position in which it is cutting evenly throughout the entire circumference of the bore in following the cutting action of the bit. As a result, the stabilized position is geometrically unique and subject to predictable calculation without having to cope with the effects of preferential cutting or deflection. Bit pinching and fatigue stresses are virtually eliminated also while minimizing the ability of certain rock formations, such as, anisotropic rock to alter the knuckle joint position. Nevertheless, as previously emphasized, while the use of a knuckle joint or other articulated joint is advantageous particularly in drainhole drilling operations, the knuckle joint may be replaced by a drill collar in conventional directional drilling operations and where the diametral clearance at the point of contact with that side of the hole between the top of the bore hole and the drill collar effectively serves the same purpose as a knuckle joint.

It is therefore to be understood that various modifications and changes in the construction and arrangement of parts and sequence of steps employed in the preferred form of invention may be made without departing from the spirit and scope of the present invention as defined by the appended claims.

I claim:

1. Apparatus for attachment to a rotary drill string in drilling a curved bore in a subsurface formation comprising:

a drill bit;

at least one articulated joint connected to the lower end of said drill string; and a reamer having a front stabilizer section interconnected for rotation between said articulated joint and said drill bit, said drill bit rigidly and directly connected to said front stabilizer section of said reamer about a common longitudinal axis therewith, said reamer including a plurality of cutting blades projecting substantially in an outward radial direction rearwardly of said front stabilizer section, said cutting blades each having an elongated cutting edge extending substantially parallel to the direction of drilling, said stabilizer section of a diameter substantially corresponding to that of said drill bit between said cutting blades and said drill bit, and said cutting blades being overgauged with respect to said drill bit and said stabilizer section.

2. Apparatus according to claim 1, said stabilizer member disposed in surrounding relation to said reamer with said cutting blades projecting radially beyond the external surface of said stabilizer member.

3. Apparatus according to claim 1, said cutting blades extending axially in spaced circumferential relation to one another, each cutting blade extending axially in a direction parallel to said longitudinal axis and terminating in elongated cutting edges at its outermost radial end surface.

4. Apparatus according to claim 3, each cutting blade having an inclined leading end portion tapering forwardly toward said drill bit from said cutting edges.

5. Apparatus according to claim 1, said stabilizer member interposed between said reamer and said drill bit and having axially extending flow channels extending in circumferentially spaced relation between said cutting blades.

6. Apparatus according to claim 5, said stabilizer member having slotted end portions in surrounding relation to said reamer with said cutting blades projecting through said slots for a limited distance beyond the external surface of said stabilizer member.

7. In apparatus for use in combination with a radial whipstock assembly wherein a drill bit is connected to the lower end of a rotary drill string for advancement along a guide surface of the whipstock in drilling a curved bore, the improvement comprising:

a reamer assembly rigidly connected to and directly behind said drill bit, said reamer assembly having a front stabilizer section directly connected to said drill bit and a plurality of cutter blades of a greater effective cutting diameter than said drill bit at a trailing end of said stabilizer section, each cutter blade having a leading end portion in facing relation to said drill bit and at least one cutting edge extending rearwardly in a direction away from said drill bit and from said leading end portion.

8. In apparatus according to claim 7, each cutter blade defined by a radial tooth covered with a hard surfacing material.

9. In apparatus according to claim 8, each reamer tooth having opposed leading and trailing end surfaces inclining toward one another and terminating in an external, squared cutting end surface portion, and said hard surfacing material applied to said external cutting edge as well as said leading and trailing end surface portions of each tooth.

10. In apparatus according to claim 7, said stabilizer section having longitudinal flow channels extending therethrough.

11. In apparatus according to claim 10, said stabilizer section having slotted end portions in surrounding relation to said reamer assembly with said cutting blades projecting through said slots for a limited distance beyond the external surface of said stabilizer member section.

12. In apparatus for use in combination with a radial whipstock assembly wherein a drill bit is connected by a flexible shaft to the lower end of a rotary drill string for advancement along a guide surface of the whipstock in drainhole drilling, the improvement comprising:

a reamer assembly including a reamer body rigidly connected to and directly behind said drill bit having cutter blades of a greater effective cutting diameter than said drill bit a stabilizer section rigidly affixed to said reamer body in leading relation to said cutter blades, said stabilizer section having longitudinal flow channels extending therethrough, said cutting blades projecting through open slots in said stabilizer section for a limited distance beyond the external surface of said stabilizer section, each cutter blade defined by a radial tooth covered with a hard surfacing material, each said tooth having leading and trailing end surfaces inclining toward said reamer body and terminating in an outer radial cutting end surface portion, said hard surfacing material applied to said cutting end surface portion and said leading and trailing end surface portions.

* * * * *